US007290432B2

(12) United States Patent
Vassena

(10) Patent No.: US 7,290,432 B2
(45) Date of Patent: Nov. 6, 2007

(54) EQUIPMENT FOR COLD-DRAWING A METAL WIRE

(75) Inventor: Giuseppe Vassena, Malgrate (IT)

(73) Assignee: Vassena Filiere s.r.l., Malgrate (IT)

( * ) Notice: Subject to any disclaimer, the term of this patent is extended or adjusted under 35 U.S.C. 154(b) by 129 days.

(21) Appl. No.: 10/530,175

(22) PCT Filed: Oct. 6, 2003

(86) PCT No.: PCT/EP03/11172

§ 371 (c)(1),
(2), (4) Date: Apr. 4, 2005

(87) PCT Pub. No.: WO2004/033121

PCT Pub. Date: Apr. 22, 2004

(65) Prior Publication Data

US 2006/0048561 A1 Mar. 9, 2006

(30) Foreign Application Priority Data

Oct. 11, 2002 (IT) ..... MI20020466 U

(51) Int. Cl.
*B21C 3/14* (2006.01)

(52) U.S. Cl. ..... 72/467; 72/274

(58) Field of Classification Search ..... 72/467, 72/282, 283, 274, 278
See application file for complete search history.

(56) References Cited

U.S. PATENT DOCUMENTS

| | | | | |
|---|---|---|---|---|
| 2,029,039 | A * | 1/1936 | Simons | 72/43 |
| 2,088,040 | A * | 7/1937 | Simons et al. | 72/282 |
| 3,080,962 | A * | 3/1963 | Fleischmann et al. | 72/42 |
| 3,752,614 | A * | 8/1973 | Bremer | 425/113 |
| 4,790,165 | A * | 12/1988 | Lievens et al. | 72/38 |
| 5,402,664 | A * | 4/1995 | Sarver et al. | 72/467 |
| 6,374,659 | B1 * | 4/2002 | Bellina | 72/467 |

FOREIGN PATENT DOCUMENTS

| | | |
|---|---|---|
| EP | 0013012 A1 | 7/1980 |
| IT | 1230396 | 10/1991 |
| IT | MI99U/000587 | 9/1999 |

OTHER PUBLICATIONS

Patent Abstracts of Japan, vol. 1997, No. 7, Jul. 31, 1997, 3 pgs. & JP 09 057333 A (Showa Electric Wire & Amp . . . ).

* cited by examiner

*Primary Examiner*—Daniel C Crane
(74) *Attorney, Agent, or Firm*—Jacobson Holman PLLC

(57) ABSTRACT

Equipment for cold-drawing a metal wire. The equipment includes a succession of a sleeve with a cylindrical hole and a threading die with a conical hole. The sleeve is inserted into a support and terminates with an extension inserted into the conical hole of the threading die. The support has a first annular projection and the threading die has a second annular projection coupled to the first projection so as to keep the sleeve and the threading die in position.

4 Claims, 2 Drawing Sheets

EQUIPMENT FOR COLD-DRAWING A METAL WIRE

This is a nationalization of PCT/EP03/11172 filed Oct. 6, 2003 and published in English.

FIELD OF THE INVENTION

The present invention refers to equipment for cold-drawing a metal wire.

BACKGROUND OF THE INVENTION

Drawing, that is the reduction of the section of a wire or other metal article through threading dies, is obtained by pulling the material through the threading die by means of drawbench machines.

A commonly used technique specially for metal wires with round section enables the drawing of metal wire to be obtained by means of successive section reductions due to the wire passing through threading dies positioned one after the other and contained, together with a tank containing lubricant for the wire, in a single equipment for wiredrawing. Lubrication in this equipment is achieved by means of interposition of lubricant between the metal wire and the threading die because of both the motion of the wire towards the threading die and the spatial geometric profile of the threading die itself.

Apparatus that enables optimal lubrication to be achieved during the entire cold-drawing operation has been described in the Italian Patent No. 1230396. This apparatus comprises an external body internally fitted with a tank containing a lubrication material. Said tank has at one end an input hole for a metal wire to be drawn, and is fitted at the other end with a first sleeve fitted with a cylindrical hole whose diameter exceeds that of the wire and a threading die fitted with a truncated cone hole with decreasing diameter towards the output so as to enable the reduction of the diameter of the wire. A spacing element of suitable conformation is positioned between the threading die and the sleeve for joining the output holes from the sleeve and the input holes into the threading die and which acts as gasket for the equipment's cooling water.

Another apparatus for cold drawing of a metal wire is described in the Italian Patent application No. MI99U000587 dated 24 Sep. 1999. The apparatus is similar to the previously described apparatus except for the fact that it does not comprise the spacing element between the sleeve with cylindrical hole and the threading die with conical hole. The sleeve terminates with an extension inserted into the conical hole of the threading die so that it is impermeable to the apparatus cooling water. Both the sleeve and the threading die are held in position by means of a threaded plug fixed to a support which in turn is fixed by means of screws onto the external body of the apparatus.

Nevertheless, mounting the threading die onto the sleeve can become a complicated operation; in fact this operation sometimes has to be repeated various times because it is difficult to insert the threading die onto the sleeve with simultaneous fastening of the threaded plug onto the body.

SUMMARY OF THE INVENTION

In view of the state of the technique described, the object of the present invention is to produce equipment for cold-drawing a metal wire that presents greater advantages in terms of mounting and thus overall cost of the equipment.

In accordance with the present invention, said object is achieved by equipment for cold-drawing a metal wire, said equipment comprising a succession of a sleeve with a cylindrical hole and a threading die with a conical hole in the advance path of the wire, said sleeve being inserted into a support and terminating with an extension inserted into said conical hole of said threading die, characterised in that said support has a first annular projection and said threading die has a second annular projection coupled to said first projection so as to keep said sleeve and said threading die in position.

BRIEF DESCRIPTION OF THE DRAWINGS

The characteristics and the advantages of the present invention will appear evident from the following detailed description of an embodiment thereof, illustrated as non-limiting example in the enclosed drawings, in which.

DETAILED DESCRIPTION OF THE PREFERRED EMBODIMENTS

Figure 1:
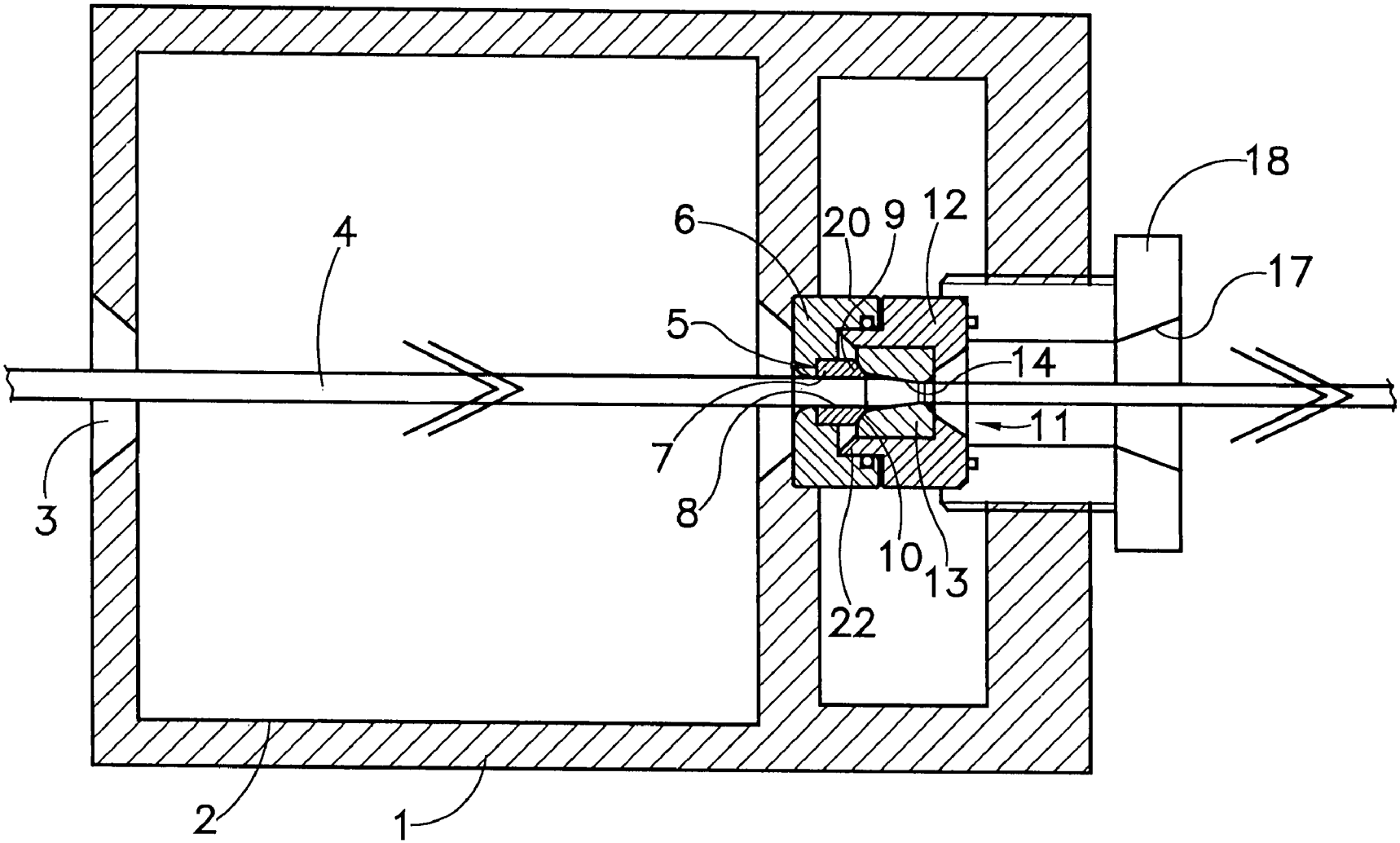
FIG. 1 shows a transversal section of the equipment according to the invention.

With reference to FIG. 1, the equipment comprises an external body 1 fitted internally with a tank 2 containing calcium or sodium-based stearates or other lubrication material. Said tank 2 presents at one side end an input hole 3 for the passage of a metal wire 4 (steel, copper, aluminium, etc.) that has to be drawn. The diameter of the hole 3 is greater than the section of the metal wire 4. The tank 2 is also fitted at the other side end with a sleeve 5 contained in a casing 6, generally made of steel, and comprising a circular-sectioned body 7, generally made of tungsten carbide commonly called hard metal or widia, fitted with a hole which in its central part 8 has a cylindrical conformation with a diameterjust greater than that of the wire 4 in input.

Figure 2:
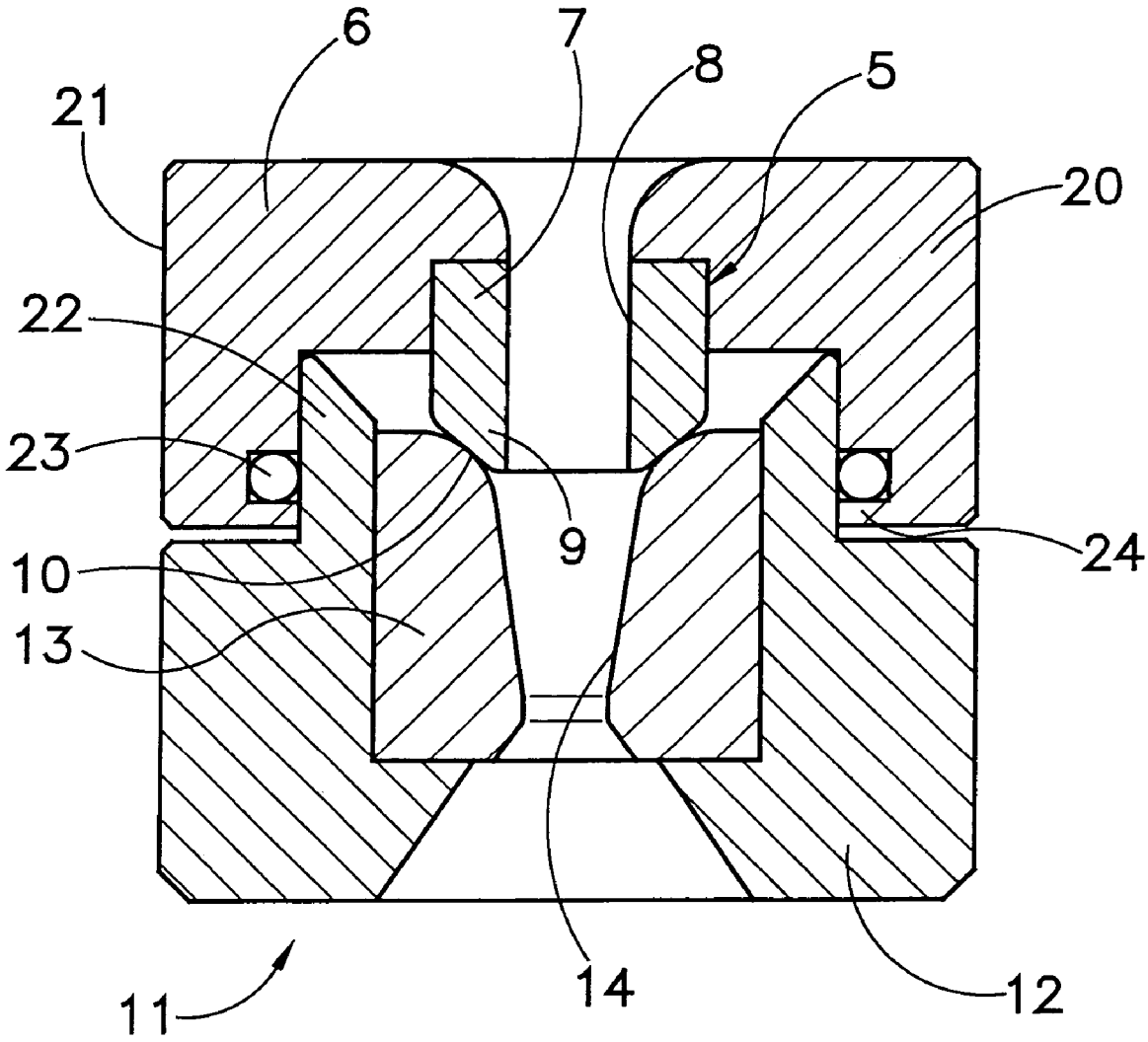
FIG. 2 shows a part of the equipment of FIG. 1 more in detail.

As can be seen better in FIG. 2, said circular-sectioned body 7 has in one of its ends a truncated cone extension 9 that juts out of the casing 6 in the central part of the casing. Said casing 6 has in addition a lower annular projection 20 on the external cylindrical skirt 21.

The extension 9 is inserted in a special funnel-shaped cavity 10 entering a threading die 11. The threading die 11 comprises a casing 12, generally made of steel, comprising a circular-sectioned body 13, generally made of widia, fitted with a conical hole which in its central part 14 has a truncated-cone conformation with decreasing diameter and whose longitudinal axis of symmetry coincides with the axis of symmetry of the hole of the sleeve 5. The casing 12 presents an upper annular projection 22.

The threading die 11 is held in position, thus similarly providing as for the position of the sleeve 5, by coupling the annular projection 22 of the threading die 11 with the annular projection 20 of the casing 6. This is carried out by means of manual pressure mounting of the threading die 11 on the casing 6.

An annular gasket 23 is also provided on the part 24 of the annular projection 20 that comes up against the annular projection 22 of the threading die 11.

The block consisting of the threading die 11 and the sleeve 5 coupled together is held in position on the body 1 by a threaded plug 15 fixed to the external body 1 and which has a discharging hole 17 passing through for the output of the wire 4.

In the drawing operation in the structure described, the metal wire 4 passing through the tank 2 picks up the lubricant contained therein. Then the wire 4 passes through the sleeve 5 without any reduction of diameter and through the threading die 11 with truncated cone hole where the wiredrawing is carried out. The lubricant reaches the wire 4 together with the sleeve 5 where it has pressure and keeps the lubricating properties suitable for the correct lubrication of the wire 4 subjected to drawing.

Mounting of the threading die 11 on the sleeve 5 by means of insertion of the truncated cone extension 9 in the funnel-shape cavity 10 must be made so as to guarantee the impermeable characteristic of the structure in relation to the cooling water of the equipment.

Mounting the equipment results simple to carry out and enables reduction of the overall cost of said operation. In fact, times for mounting the threading die 11 on the casing 6 containing the sleeve 5 are reduced as the presence of the plug 15 is now required only for positioning the sleeve-threading die block on the body 1 given that both the sleeve 5 and the threading die 11 are already positioned in relation to each other by coupling the projections 20 and 22.

The invention claimed is:

1. Equipment for cold-drawing a metal wire, said equipment comprising a succession of a sleeve with a cylindrical hole and a threading die with a conical hole in an advance path of the wire, said sleeve being located in a support casing and terminating with an extension extending into said conical hole of said threading die, said support casing having a first unthreaded annular projection and said threading die having a second unthreaded annular projection extending into and coupled to said first projection by manual axial pressure mounting to keep said sleeve and said threading die in position.

2. Equipment according to claim 1, further comprising an annular gasket located in a part of said first projection abutting against said second projection.

3. Equipment according to claim 1, wherein said extension of the sleeve is inserted into the conical hole of the threading die so that said extension is isolated from cooling water.

4. Equipment according to claim 1, further comprising a wire lubrication tank and the sleeve and the threading die are positioned at an output of said tank.

* * * * *